United States Patent [19]

Kock

[11] Patent Number: 4,979,737

[45] Date of Patent: Dec. 25, 1990

[54] APPARATUS FOR EXERCISING LOWER LEG MUSCLES

[76] Inventor: Ronald W. Kock, 577 Abilene Trail, Wyoming, Ohio 45215

[21] Appl. No.: 376,256

[22] Filed: Jul. 6, 1989

[51] Int. Cl.[5] ..... A63B 23/04; A63B 23/08

[52] U.S. Cl. ..... 272/96; 272/116; 272/143; 272/132

[58] Field of Search ..... 272/70, 93, 94, 96, 272/116, 117, 131, 132, 135, 136, 138; 128/25 R, 25 B

[56] References Cited

U.S. PATENT DOCUMENTS

| | | | |
|---|---|---|---|
| Re. 23,744 | 11/1953 | Magida . | |
| D. 189,011 | 10/1960 | Berne . | |
| 3,103,357 | 9/1963 | Berne . | |
| 3,465,592 | 9/1969 | Perrine . | |
| 3,525,522 | 8/1970 | Piller . | |
| 3,717,338 | 2/1973 | Hughes . | |
| 3,784,194 | 1/1974 | Perrine . | |
| 3,929,331 | 12/1975 | Beeding . | |
| 4,066,259 | 1/1978 | Brentham . | |
| 4,159,111 | 6/1979 | Lowth . | |
| 4,186,920 | 2/1980 | Fiore et al. . | |
| 4,225,130 | 9/1980 | Zimmerman . | |
| 4,240,627 | 12/1980 | Brentham . | |
| 4,278,249 | 7/1981 | Forrest . | |
| 4,306,714 | 12/1981 | Loomis et al. . | |
| 4,374,588 | 2/1983 | Ruggles . | |
| 4,408,759 | 10/1983 | Reneau et al. . | |
| 4,452,447 | 6/1984 | Lepley et al. . | |
| 4,502,681 | 3/1985 | Blomquist . | |
| 4,570,925 | 2/1986 | Kock et al. . | |
| 4,605,220 | 8/1986 | Troxel . | |
| 4,650,183 | 3/1987 | McIntyre . | |
| 4,709,920 | 12/1987 | Schnell | 272/117 |
| 4,733,859 | 3/1988 | Kock et al. | 272/96 |

OTHER PUBLICATIONS

"How I Manage Infrapatellar Tendinitis" by Jos. E. Black, MD, *The Physician and Sportsmedicine,* 10/84, pp. 86–92.

*Primary Examiner*—Robert Bahr
*Assistant Examiner*—Lynne A. Reichard

[57] ABSTRACT

Apparatus for lower leg exercise wherein dorsiflexion and plantarflexion movements of the foot, about a machine axis substantially aligned with the axis of the ankle, are resisted by a frictional torque that varies in a predetermined manner with the angular position of the foot. Reducing the extent of friction contact surface overlap and/or reducing the radius to the perimeter of friction contact surface overlap causes torsional resistance to decrease. As the foot rotates about the ankle to either side of its neutral position, the natural leverage of the leg muscles opposing torsional resistance decreases. Corresponding reduction of resistance with reduction of muscle leverage permits the range of motion of lower leg exercise to be increased. In the preferred embodiment the apparatus has a handle and base which permit operation from a supine position on a bed, training table, or floor, with leg extended horizontally.

11 Claims, 5 Drawing Sheets

APPARATUS FOR EXERCISING LOWER LEG MUSCLES

FIELD OF THE INVENTION

The present invention relates to friction resistance devices and more particularly to friction resistance type exercise machines. Even more particularly, the present invention relates to lower leg exercisers with variable friction resistance.

BACKGROUND OF THE INVENTION

Lower leg exercise involves muscles from the knee to the ankle and muscles surrounding the ankle. Lower leg muscles are exercised by rotational movements of the foot about the ankle joint. Lower leg exercise machines commonly provide one or two footplates with adjustable resistances against which the user may exert a force. Such exertion, when regularly repeated, results in lower leg muscle strengthening, improved muscle endurance, and increased joint motion flexibility. These results are key to prevention and rehabilitation of lower leg muscle and joint injuries.

As physical exercise for recreation and for cardiovascular fitness increases in popularity, so do the injuries associated with the lower leg. Ankle sprains are the most frequent injuries associated with recreation and fitness exercise. Knee injuries are also common. Running and jumping, for example, are known to cause a knee injury medically described as infrapatellar tendinitis, resulting in pain at the shin just below the kneecap. This particular injury and its rehabilitation exercises are described in an article "How I Manage Infrapatellar Tendinitis" by Joseph E. Black, MD, in the October, 1984, issue of *The Physician and Sportsmedicine*, pages 86–92. A principal object of the present invention is to enable individuals to perform the recommended exercise to prevent and rehabilitate this injury.

When serious athletes have lower leg injuries, the supervised care of an athletic trainer or physical therapist may be appropriate to hasten the return of the athlete to full competitive ability. However, for the non-athlete, fitness buff, or recreational player, the objective is not the fastest return to competition. It is instead to quickly regain the capability of walking straight ahead on both feet without a limp. Such movement involves the feet pivoting back and forth in a substantially vertical plane. This motion is technically known as dorsiflexion and plantarflexion.

Commercially available lower leg exercise machines are designed for use at centralized facilities, such as sports medicine clinics and university training rooms. These machines provide for foot movement against resistance in two or three different planes simultaneously. Some have built in seats and elaborate resistance measurement feedback systems. They are complex and costly machines that are economically justified by application to multiple patients. Examples include U.S. Pat. No. 4,650,183 to McIntyre, which discloses a two axis machine with seat and hydraulic gage console; U.S. Pat. No. 4,733,859 to Kock et al, which shows a two axis machine with seat; and U.S. Pat. No. 4,452,447 to Lepley et al., disclosing a three axis machine. These machines provide for exercise in the inversion/eversion and adduction/abduction planes in addition to the dorsiflexion/plantarflexion plane in order to provide complete ankle rehabilitation. Missing from the marketplace are affordable, single-axis, lower leg exercisers for individuals to use at their own convenience at home.

In hospitals where patients are bedridden, a nurse often must manually massage a patient's lower legs to stimulate circulation so that varicose veins and the development of thrombophlebitis can be avoided. There is a need for a small and light weight lower leg exerciser that can be attached by a nurse to a supine patient's foot, with means for providing exerciser stability on a bed, so the patient can perform a lower leg exercise by him or herself. Such an exerciser might eliminate the need for manual massage since exercise stimulates blood circulation. Also, leg exercise would help to maintain lower leg muscle strength in the immobile patient.

U.S. Pat. No. 4,159,111 to Lowth, U.S. Pat. No. 3,525,522 to Piller, and U.S. Design Pat. No. 189,011 to Berne disclose single-axis lower leg exercisers. These machines have significant deficiencies for supine patient use, however. Because the footplate pivot points are located opposite the footplate from the user's ankle joint, substantial movement of the patient's leg is required to rotate a footplate. This movement is easily accomplished in a sitting position with the knee bent, but it is difficult in the supine position with the leg straightened. Also, these inventions are shown with horizontal base plates beneath the footplate pivots. The bases of the Lowth, Piller and Berne exercisers would be unstable to torsional moments when resting on a non-rigid bed surface. They would slide and tilt on the bed surface.

Resistance exercise of major body muscle groups is commonly done using free weights grasped by the hands or by using machines which have cables connecting pivoting members to weight stacks. These resistance means are not practical for ankle exercise. The high resistance levels needed for major muscle groups are not needed for ankle exercise. And the relatively small angle of rotation of the foot (short stroke) permits more compact resistance means to be used. Hydraulic cylinders and friction disks are the predominant resistance means used for lower leg exercisers. U.S. Pat. No. 4,605,220 to Troxel shows four hydraulic shock absorbers attached between a footplate and base. U.S. Pat. No. 4,650,183 to McIntyre shows two rotary hydraulic actuators connecting a footplate to a base. And U.S. Pat. No. 4,452,447 to Lepley et al. shows three hydraulic cylinders connected from a base to footplate cranks. Although smooth and speed controlled motion is provided by hydraulic resistance, disadvantages are its high cost and eventual leakage of hydraulic fluid. Friction disks, on the other hand, are inexpensive, more compact, and don't leak. The latter two features are especially important for a portable device for use in a hospital bed, for example.

Most exercise machines provide a constant resistance throughout the range of motion of a body member about its joint. But as the body member moves, the leverage of the muscle(s) being stressed changes. There is a position at which leverage is greatest. At the ends of the range of body member motion the leverage is usually lowest. Thus, if the resistance is set for optimum muscle stress at the greatest leverage position, the range of motion under this resistance will be very limited. On the other hand, if the resistance is set for optimum muscle stress at the ends of the range of motion, the resistance may be too low at the center of the range of motion. It is desired to have the resistance level vary with muscle leverage so that each muscle is evenly stressed throughout its range of movement.

OBJECTS OF THE INVENTION

In light of the above, the principal object of the present invention is an inexpensive and portable apparatus for an individual to perform dorsiflexion/plantarflexion exercises at home or office for personal rehabilitation of lower leg injuries, such as infrapatellar tendinitis.

Another principal object of the present invention is a light-weight, stable, lower leg exercise device which can be operated easily by supine patients in a bed to relieve hospital nursing staff from performing time-consuming lower leg massaging activities.

Still another object of the present invention is a friction resistance system in which torsional resistance varies with the leverage of the muscles opposing it, to maximize the range of motion over which the muscles are evenly stressed.

SUMMARY OF THE INVENTION

In practicing the present invention lower leg exercises are performed by a user preferably in a supine position with legs extended horizontally. The user may lie on a bed, training table, or the floor, for example. In a hospital a nurse may strap the footplate to the patient's foot. However, a healthy individual can strap his or her own foot to the footplate when sitting upright with legs bent.

The neutral or resting position of the foot is its position when no force is exerted to rotate it about the ankle joint. This position is substantially perpendicular to the lower leg, or vertical when the leg is horizontal. The normal range of motion of the foot is 15° dorsiflexion (rotation toward the body) from neutral and 35° plantarflexion (rotation away from the body) from neutral. The total motion range is therefore 50°, although some people have a range as great as 70°. At ±5° from the neutral position, the torsional resistance that can be overcome is approximately 5 times the resistance that can be overcome near the extremes of the motion range. The leverage drops off rapidly at the range extremes.

In the preferred embodiment of the present invention, the axis of footplate rotation is preferably about 3 inches (7.6 cm) from the surface of the footplate, substantially aligned with the axis of the user's ankle when the user's foot is properly secured to the footplate. Thus, when a supine user rotates his foot in a dorsiflexion or plantarflexion motion, only his foot and the footplate move. The upper leg muscles are effectively isolated from the motion because the leg is straight. There is no need for kneepads or thighstraps, common with seated position exercisers, to provide this isolation.

The rotation of the footplate against friction resistance exerts a reaction torque that tends to tilt the machine about its base. In order that the user can exercise without assistance, a handle, preferably about 3 feet (91 cm) long, is extended from the body of the machine so that the user can hold it to prevent rotation of the mechanism about its base. The force at the end of the handle is very low because the handle is so much longer than the 3 inch (7.6 cm) footplate moment arm. The handle provides for stability of the exerciser base especially for use on a bed surface.

In order that the preferred embodiment of the present invention be portable and inexpensive, it is designed to be constructed of common, lightweight materials such as phenolic, rigid polyvinyl chloride (PVC), and zinc and aluminum castings. The lower leg exerciser of the present invention weighs less than 12 pounds (5.4 kg). The primary components of the lower leg exerciser are: the footplate with adjustable footstrap, pivot bracket with threaded shaft, bearing block with baseplate and handle, rotatable and fixed friction disks, compression spring, handwheel for adjusting spring pressure against friction disks, and three non-precision ball bearings. Their combined fabricated cost is currently less than $80.

In the preferred embodiment of the present invention, the footplate resistance is achieved by two 6 inch (15.2 cm) diameter coaxial friction disks. One is connected to the footplate pivot bracket and the other to the bearing block and base. One rotates with the foot while the other remains stationary. A spring with adjustable compression presses the two disks together. Their interface is preferably a combination of low coefficient of friction materials; for example, aluminum against cork with a light coating of silicone grease therebetween. The friction interface has a contact area that varies in a predetermined manner with the angle of footplate rotation. This variation enables the lower leg muscles opposing the resistance to be stressed more evenly throughout their range of motion.

In the preferred embodiment of the present invention the circular friction disks have preferably four raised sectors, each preferably 50° in arc length. At the neutral position of the footplate the sectors from both disks are fully overlapping. Here the greatest contact area exists and the friction resistance is maximum. As the rotatable disk connected to the footplate is rotated relative to the stationary disk, the amount of sector overlap decreases. Therefore, as the footplate is rotated toward the extremes of its range in either direction from the neutral position, the contact area and friction resistance decreases. The torsional friction resistance 35° from the neutral position using this method is about 72% of the resistance at the neutral position, for example.

DETAILED DESCRIPTION OF THE INVENTION

Figure 1:
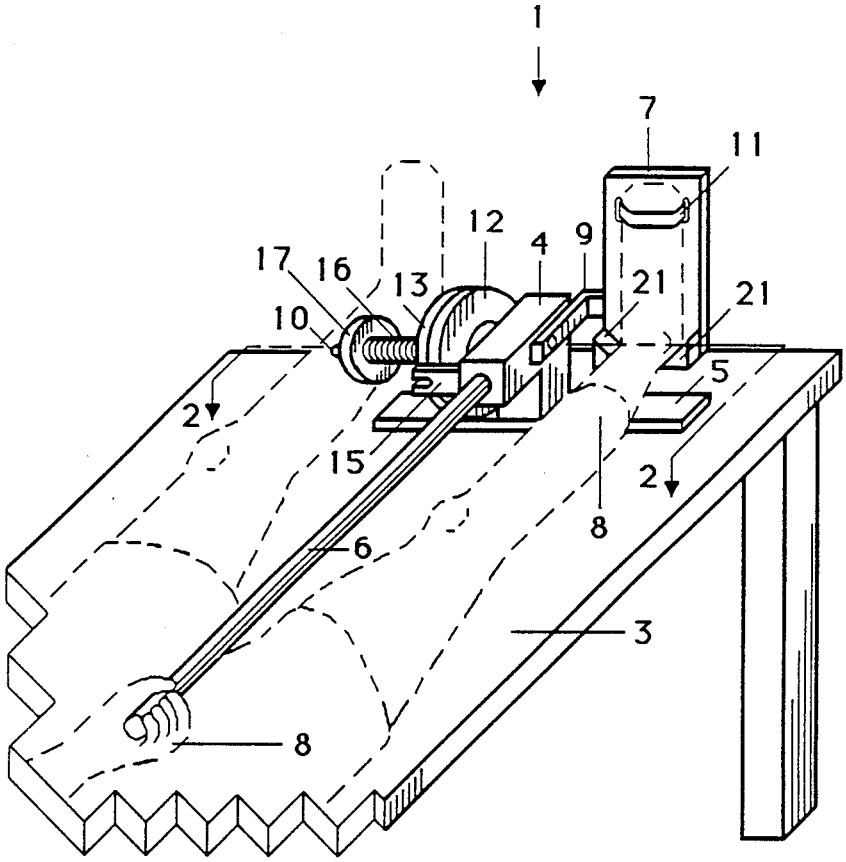
FIG. 1 is a perspective view of the preferred embodiment of the present invention operated, as shown in phantom, by a patient in the supine position on a training table.

Referring now to the drawings, and more particularly to FIG. 1, there is shown a preferred embodiment of the present invention, generally indicated as 1. Lower leg exerciser 1 is operated by supine patient 8, depicted by dotted lines, on training table 3. The exerciser 1 is constructed with a support, preferably in the form of "L" shaped bearing block 4 attached to baseplate 5, which rests on table 3. A handle 6 is rigidly connected to bearing block 4 and is preferably long enough to permit supine patient 8 to grip it with one hand while operating exerciser 1. When gripped by patient 8 during exercise, handle 6 prevents baseplate 5 rocking back and forth. Baseplate 5 is preferably long enough to extend under all parts of exerciser 1 to prevent exerciser 1 tilting to the side during exercise.

A pivot bracket 9 is rigidly connected to a threaded shaft 10, which extends through and is rotatably mounted on bearing block 4, with its longitudinal axis substantially parallel to baseplate 5. A footplate 7 is rigidly attached to pivot bracket 9. Pivot bracket 9 serves to provide rotational forces to shaft 10, in response to movement of footplate 7 by the foot of patient 8 during the exercise cycle. The foot of patient 8 is located on footplate 7 such that the longitudinal axis of shaft 10 is substantially aligned with the ankle joint of patient 8. The distance from the longitudinal axis of shaft 10 to footplate 7 is preferably about 3 inches (7.6 cm). Adjustable footstrap 11, preferably cloth belting with Velcro fasteners, secures the ball of the foot of patient 8 to footplate 7 for dorsiflexion exercises. In this exercise the patient's foot pulls footplate 7 counterclockwise when viewed from the footplate end of exerciser 1. Alternatively, a rigid metal bar could replace footstrap 11. If adjustable along the length of footplate 7, it too could secure the foot of patient 8 to footplate 7.

Heel blocks 21 at the lower end of footplate 7 support the heel of patient 8. Because the axis of rotation of pivot bracket 9 is substantially aligned with the ankle of patient 8, a footstrap is preferably not used to secure the heel of patient 8 to footplate 7. Pressing footplate 7 clockwise in the plantarflexion exercise does not result in the heel of patient 8 lifting off footplate 7 when the ankle and pivot bracket alignment are close. Therefore, once the footstrap 11 is adjusted to one of the feet of patient 8, either foot of patient 8 can easily be slid in and out of closed footstrap 11 without loosening it. This arrangement enhances the ease with which patient 8 can operate exerciser 1 from a supine position.

Attached to threaded shaft 10 on the opposite side of bearing block 4 from pivot bracket 9 is rotatable friction disk 12. Coaxial, fixed friction disk 13 is substantially the same size as disk 12 and is urged against disk 12 preferably by compression spring 16, shown more clearly in FIG. 2. Friction disk 13 is preferably secured from rotation by engagement with angle bracket 15 mounted to the side of bearing block 4. A handwheel 17, threaded onto shaft 10 against the opposite end of spring 16 from disk 13, is rotated to adjust the compression force of spring 16 against friction disk 13.

Figure 2:
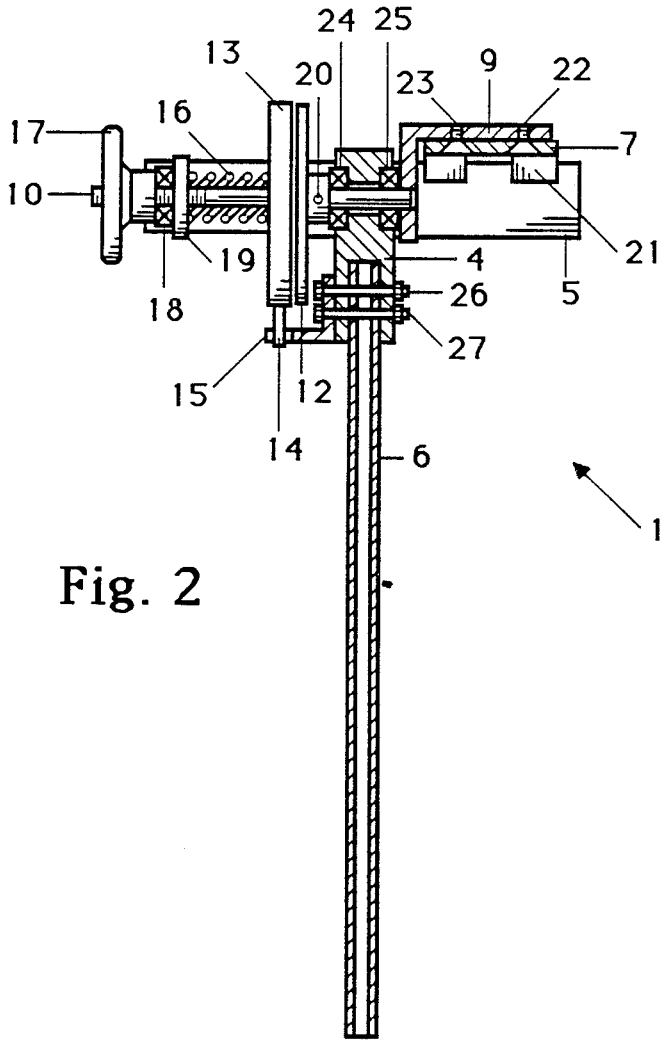
FIG. 2 is a sectioned plan view taken along line 2—2 of FIG. 1, showing the components of the lower leg exercise apparatus.

FIG. 2 discloses more detail of the preferred embodiment of the present invention, shown as 1. This sectioned view is taken along a horizontal plane which passes through the longitudinal axis of shaft 10. Friction disk 13 preferably has pin 14 extending radially to engage an axially oriented slot in angle bracket 15. This means of preventing rotation of disk 13 allows disk 13 to slide along shaft 10 in order that spring 16 may press the friction surface of disk 13 against that of disk 12.

Angle bracket 15 is preferably attached to bearing block 4 by bolts 26 and 27, which also extend through handle 6 to secure it to bearing block 4. Bearing block 4 preferably has two flanged ball bearings 24 and 25 pressed into opposite sides of a clearance hole for shaft 10 through bearing block 4. Pivot bracket 9 is preferably welded to threaded shaft 10. Rotatable disk 12 is preferably pinned to shaft 10 by pin 20 after shaft 10 is inserted through bearings 24 and 25. This sequence insures the axial play of shaft 10 in bearings 24 and 25 is minimized.

Shaft 10 oscillates in a rotary path about its longitudinal axis along with footplate 7 during operation. Handwheel 17 is threaded onto shaft 10. In order to maintain the compression on spring 16 constant during operation of exerciser 1, handwheel 17 preferably rotates with shaft 10. However, friction disk 13 cannot rotate because of its engagement with angle bracket 15, and compression spring 16 is compressed against disk 13 and also cannot rotate. Therefore, washer 19 and thrust bearing 18 are preferably inserted between handwheel 17 and spring 16 to enable handwheel 17 to rotate while compressing non-rotating spring 16.

Footplate 7 is preferably attached to pivot bracket 9 by means of two flat head screws, 22 and 23. Several pairs of screw holes in footplate 7 for screws 22 and 23 permit footplate 7 to be located on pivot bracket 9 such that different length feet can have ankles aligned with the longitudinal axis of shaft 10.

Figure 3:
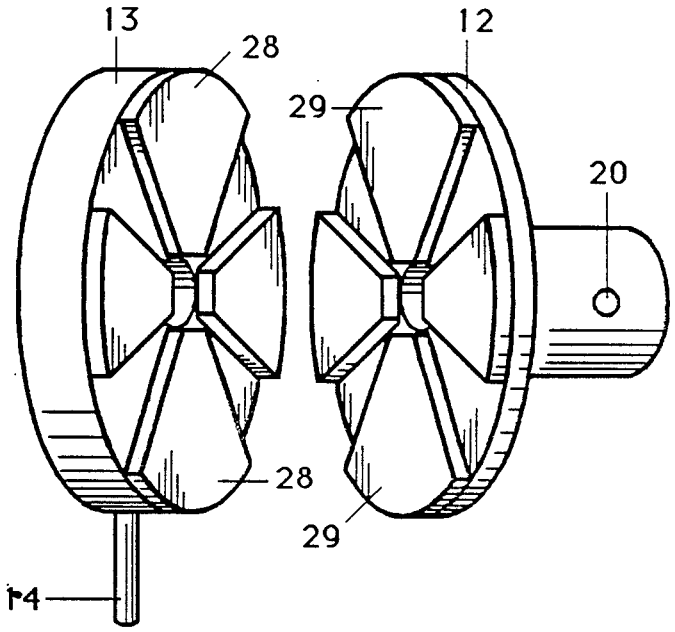
FIG. 3 is a perspective view of the friction disks of the lower leg exercise apparatus, with the disks being illustrated in an opened condition to permit unobstructed viewing of their sector-shaped contact areas.

FIG. 3 shows the interface between friction disks 12 and 13. Rotatably-fixed friction disk 13 has preferably four equally-spaced, 50° arc length, raised, sector-shaped friction pads 28 attached to it. Rotatable friction disk 12 also has preferably four equally-spaced, 50° arc length, raised, sector-shaped friction surfaces 29 that contact those on disk 13. The orientation of pins 14 and 20 is such that when handle 6 is horizontal and footplate 7 is vertical, surfaces 28 substantially overlap matching surfaces 29. There is preferably a 40° gap between each raised friction surface 28 and 29. Because this gap is less than the 50° arc length of the friction surfaces, rotation of one disk relative to the other cannot cause the raised surfaces of one disk to fall into the gaps of the other.

Figure 4:
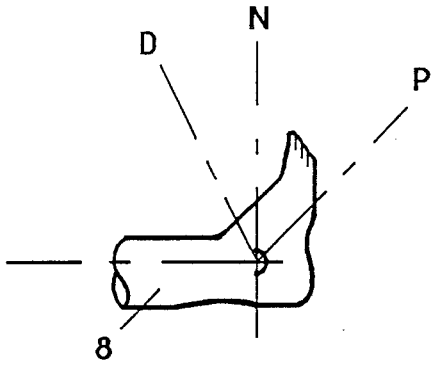
FIG. 4 is a side elevation view of a right foot, showing its neutral position centerline, dorsiflexion position centerline and plantarflexion position centerline at the ankle joint.

FIG. 4 shows the right foot of patient 8 with three centerlines extending from the ankle joint. Centerline N is parallel to the bottom of the foot and is substantially vertical when the leg of patient 8 is horizontal. This represents the neutral or resting position of the foot. Centerline D represents the extreme dorsiflexion position of the foot, typically 15°-25° from centerline N. Centerline P represents the extreme plantarflexion position of the foot, typically 35°-45° from centerline N.

Figures 5A, 5B, 5C:
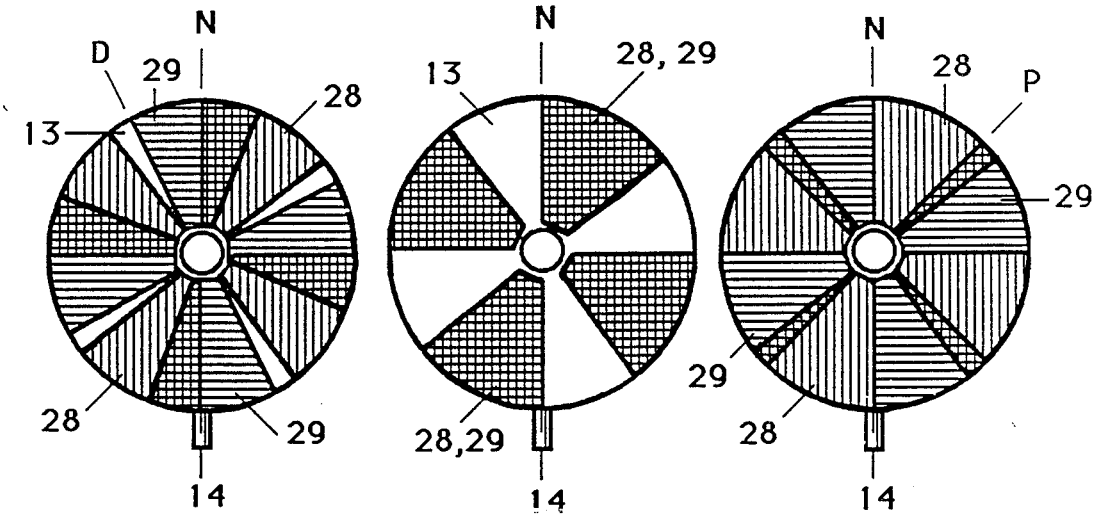
FIGS. 5*a*, 5*b*, and 5*c* are overlay views providing schematic representations of coaxial friction disks, showing the alignment of four, equally-spaced, sector-shaped contact areas when the footplate is rotated to the extreme dorsiflexion position, neutral position and extreme plantarflexion position, respectively.

FIGS. 5*a*, 5*b*, and 5*c* diagrammatically show the overlap of sector-shaped friction surfaces illustrated on disks 12 and 13. Surfaces 28 on disk 13 are identified by vertical lines. Surfaces 29 on disk 12 are identified by horizontal lines. Their overlap is represented by areas having both vertical and horizontal lines. FIG. 5*b* shows both sets of friction surfaces substantially overlapped. This is the preferred condition when the foot of patient 8 is in the neutral position. FIG. 5*a* shows the partial overlap of friction surfaces 28 and 29 when disk 12 is rotated by the foot of patient 8 to the extreme dorsiflexion position. The overlap area is substantially reduced from what it is in FIG. 5*b*. FIG. 5*c* shows the partial overlap of friction surfaces 28 and 29 when disk 12 is rotated by the foot of patient 8 to the extreme plantarflexion position. Again the overlap area is substantially reduced from what it is in FIG. 5*b*.

It is believed that the reduction in friction contact area under the same spring pressure results in reduced torsional resistance as one disk is rotated relative to the other. Measurements of six inch (15.2 cm) diameter disks, with the preferred friction surface materials of polished aluminum against silicone grease-coated cork, indicate percent of maximum torsional resistance for different overlaps. When overlap arc length is 50° at each sector, friction torque is maximum. When overlap arc length is 35° at each sector, friction torque is 88% of maximum. When overlap arc length is 15° at each sector, friction torque is 72% of maximum. The reduction in torsional resistance as disk 12 is rotated in either direction from the neutral position corresponds to the reduction in leverage of the lower leg muscles. Although the correspondence is not exact, any such reduction of resistance as the muscle leverage decreases enables the range of motion of the exercise to be beneficially increased.

The variable-contact-area method of matching resistance to muscle leverage is preferred for the lower leg exerciser of the present invention. Other more complicated methods of varying resistance with footplate angular position, which are not preferred, are cams and linkages between footplate and source of resistance. These change the mechanism leverage rather than the resistance.

Figure 6A:
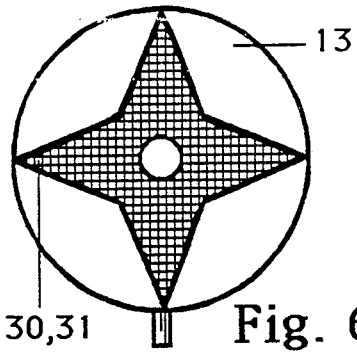
FIGS. 6*a* and 6*b* are overlay views, similar to FIGS. 5*b* and 5*c*, of alternative coaxial friction disks, showing the alignment of four-pointed star-shaped contact areas when the footplate is rotated to a position where areas are fully overlapped and to a position where minimum overlap occurs.
Figure 6B:
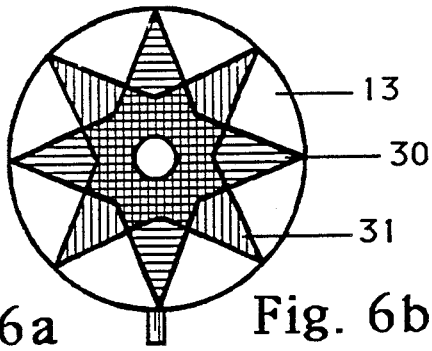

For other friction resistance devices, alternate contact surface shapes may better fit the desired angle of rotation and resistance criteria. Some alternatives are shown in the remaining figures. FIGS. 6*a* and 6*b* show an alternative to the preferred four sector-shaped surfaces of the present invention. The substantially overlapped surfaces 30 and 31 of FIG. 6*a* define a four-pointed star. FIG. 6*b* shows one disk rotated relative to the other by 45°. Not only is the resulting overlap area reduced to a minimum, but also, the radius to the perimeter of the overlap area is reduced to a minimum. It is believed that the reduction of the radius to the perimeter of the overlap area reduces torsional resistance, and that a combined reduction of overlap area and radius to its perimeter reduces torsional resistance more substantially than if either area or radius to perimeter of area is reduced independently.

Figure 7A:
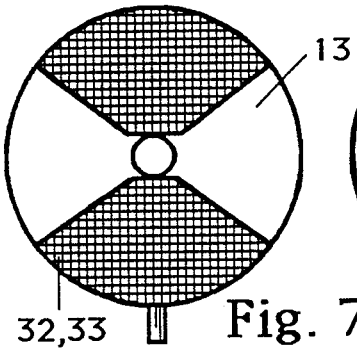
FIGS. 7*a* and 7*b* are overlay views, similar to FIGS. 5*b* and 5*c*, of alternative coaxial friction disks, showing the alignment of double sector-shaped contact areas when the footplate is rotated to a position where areas are fully overlapped and to a position where 50% overlap occurs.
Figure 7B:
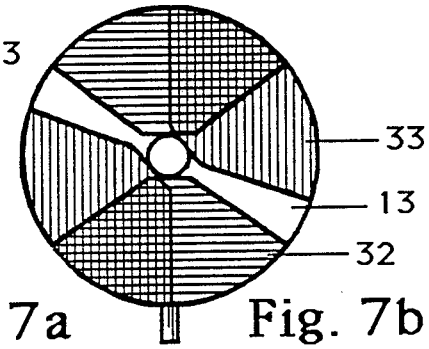
Figure 8A:
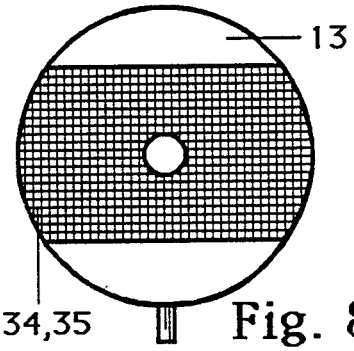
FIGS. 8*a* and 8*b* are overlay views, similar to FIGS. 5*b* and 5*c*, of alternative coaxial friction disks, showing the alignment of truncated circle contact areas when the footplate is rotated to a position where areas are fully overlapped and to a position where minimum overlap occurs.
Figure 8B:
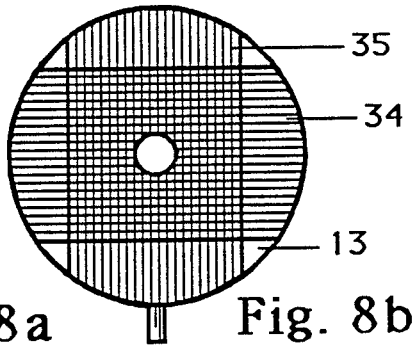
Figure 9A:
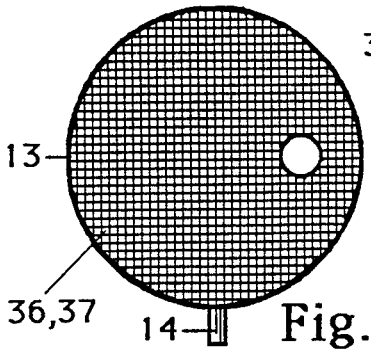
FIGS. 9*a* and 9*b* are overlay views, similar to FIGS. 5*b* and 5*c*, of alternative circular friction disks with common but offset centers of rotation, showing the alignment when the footplate is rotated to a position where areas are fully overlapped and to a position where minimum overlap occurs.
Figure 9B:
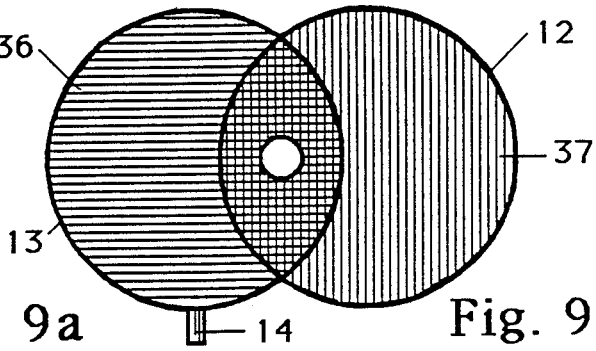

FIGS. 7*a* and 7*b* show coaxial disks with two 100° arc length sector-shaped surfaces 32 and 33. In FIG. 7*a* surfaces 32 and 33 are substantially overlapped. In FIG. 7*b* the overlap is reduced by 50% when one disk is rotated 50° relative to the other. At a rotation of 80° in either direction the overlap area would reach its minimum. FIGS. 8*a* and 8*b* show coaxial disk surfaces 34 and 35, each with two opposing circular segments removed. In FIG. 8*a* the surfaces are substantially overlapped. In FIG. 8*b* one disk is rotated 90° to the other to where the overlap area is minimized. FIGS. 9*a* and 9*b* show circular disk surfaces 36 and 37 which have rotational axes offset from the centers of the disks. In FIG. 9*a* the circular surfaces are substantially overlapped. In FIG. 9*b* one disk is rotated 180° relative to the other to a minimum overlap area.

The preferred embodiment of the present invention is preferably constructed of common materials. Referring to FIG. 2, bearing block 4, for example, is preferably a lightweight material that is easily machined from a 2 inch by 5 inch by 6 inch (5.1 cm by 12.7 cm by 15.2 cm) block of rigid polyvinyl chloride (PVC) or phenolic. Baseplate 5 is preferably a 0.25 inch by 2 inch by 14 inch (6.4 mm by 5.1 cm by 35.5 cm) long rigid PVC or phenolic strip which is fastened by screws or adhesively bonded to one end of bearing block 4. Extending from a pilot hole in the other leg of "L" shaped bearing block 4 is preferably a hollow one inch (2.5 cm) diameter by 3 foot (91 cm) long handle 6 made of preferably rigid PVC or phenolic tubing. Footplate 7 is preferably an aluminum casting 0.38 inches (9.6 mm) thick by 5 inches (12.7 cm) wide by 12 inches (30.5 cm) long, with preferably 1.4 inch (3.6 cm) high heelblocks 21 cast perpendicular to the foot contacting surface of footplate 7. Each heelblock 21 is preferably angled 45° to the longitudinal axis of footplate 7. This configuration forms a wedge to center the foot of patient 8 on footplate 7. Pivot bracket 9, to which footplate 7 is attached by two flathead screws 22 and 23, is preferably made of a 1.25 inch (3.2 cm) wide section of 0.38 inch (9.6 mm) thick 5 inch by 5 inch (12.7 cm by 12.7 cm) structural steel angle. Preferably plug-welded substantially perpendicular to pivot bracket 9 is threaded shaft 10, preferably 0.749 inch (1.902 cm) diameter by 8 inches (20.3 cm) long and made of cold rolled steel. Shaft 10 preferably has $\frac{3}{4}$-10 NC thread cut along the outer 3 inches (7.6 cm) opposite its welded end. Shaft 10 preferably slips through non-precision, 0.750 inch (1.905 cm) bore steel ball bearings 24 and 25, such as Heim model RF-12-22-14. These bearings are preferably press fit into opposite sides of bearing block 4.

Rotatable friction disk 12 and rotatably-fixed friction disk 13 are preferably circular disks made of cast aluminum, with 0.755 inch (1.918 cm) diameter bores, 0.25 inch (6.4 mm) and 0.5 inch (1.3 cm) thick faces respectively, and 6 inch (15.2 cm) outer diameters. Disk 12 has a hub which is preferably pinned to shaft 10 by means of a 0.25 inch (6.4 mm) diameter by 1.5 inch (3.8 cm) long steel spring pin 20. Preferably pressed into and extending radially from disk 13 is a second spring pin 14 of the same material and size as pin 20. It preferably engages a 0.28 inch (7.1 mm) wide by 0.5 inch (1.3 cm) long slot in angle bracket 15, bolted to the side of bearing block 4. Angle bracket 15 is preferably a 1.25 inch (3.2 cm) wide section of 0.25 inch (6.4 mm) thick by 2 inch by 2 inch (5.1 cm by 5.1 cm) aluminum structural angle. Attached to disk 13 are preferably four raised sector-shaped friction surfaces 28, made of 0.13 inch (3.3 mm) thick cork.

These are preferably attached to disk 13 by means of double-sided foam urethane tape. Cast aluminum raised sector-shaped surfaces 29 of disk 12 are preferably lathe faced smooth. Reducing the coefficient of friction between surfaces 28 and 29 is preferably a silicone grease lightly coating cork surfaces 28.

Compression spring 16 is preferably a 0–200 pound (0–91 kg) force helical-wound spring made of 9 coils of 6 gage music wire. Its outside diameter is preferably 1.25 inches (3.2 cm) and its free length is preferably 3 inches (7.6 cm). Hand wheel 17 is preferably an aluminum or zinc diecast part with $\frac{3}{4}$-10 NC internal thread and 2.5 inch (6.35 cm) outside diameter. Thrust bearing 18 is preferably the same as bearings 24 and 25, with one race in contact with handwheel 17 and the other race contacting washer 19. Washer 19 is preferably a $\frac{7}{8}$ inch (2.2 cm) SAE flat washer.

It is though that the lower leg exerciser of the present invention, and many of its attendant advantages, will be understood from the foregoing description; and it will be apparent that various changes may be made in form, construction, and arrangement without departing from the spirit and scope of the invention or sacrificing all of its material advantages; the form hereinbefore described being merely a preferred or exemplary embodiment thereof.

What is claimed is:

1. An apparatus for varying torsional resistance between friction surfaces, said apparatus comprising:

(a) a rotatable friction member having a first contact surface;

(b) a rotatably-fixed friction member having a second contact surface; and (c) means for biasing said first and second contact surfaces against each other to provide torsional resistance to rotation of said rotatable member, said resistance varying in a predetermined manner according to the angular position of said rotatable member relative to said rotatably-fixed member by varying the extent of the overlapping contact area between said first and second contact surfaces as said rotatable member is rotated.

2. The apparatus of claim 1 wherein said torsional resistance is also varied by varying the radius to the perimeter of overlapping contact area between said first and second contact surfaces as said rotatable member is rotated.

3. The apparatus of claim 1 further comprising:

(a) a footplate connected to said rotatable friction member, said footplate adapted to secure a user's foot to said footplate; and (b) means for supporting said rotatable and rotatably-fixed friction members so as to permit dorsiflexion and plantarflexion motions of said user's foot against said varying torsional resistance.

4. The apparatus of claim 3 wherein said first and second contact surfaces are positioned to have maximum overlapping area when said footplate, secured to said user's foot, is substantially perpendicular to said user's lower leg, said contact surfaces having less overlapping area when said footplate is rotated beyond substantially perpendicular in either direction.

5. An apparatus for varying torsional resistance between friction surfaces, said apparatus comprising:

(a) a rotatable friction member having a first contact surface;

(b) a rotatably-fixed friction member having a second contact surface; and (c) means for biasing said first and second contact surfaces against each other to provide torsional resistance to rotation of said rotatable member, said resistance varying in a predetermined manner according to the angular position of said rotatable member relative to said rotatably-fixed member by varying the radius to the perimeter of the overlapping contact area between said first and second contact surfaces as said rotatable member is rotated.

6. The apparatus of claim 5 further comprising:

(a) a footplate connected to said rotatable friction member, said footplate adapted to secure a user's foot to said footplate; and (b) means for supporting said rotatable and rotatably-fixed friction members so as to permit dorsiflexion and plantarflexion motions of said user's foot against said varying torsional resistance.

7. An apparatus attached to a user's foot for exercising the muscles of said user's lower leg and ankle, said apparatus comprising:

(a) a baseplate;

(b) a bearing block connected to said baseplate;

(c) a shaft rotatably mounted in said bearing block, said shaft having a longitudinal axis;

(d) a footplate connected to said shaft, said footplate adapted to secure said user's foot thereon with said user's ankle substantially aligned with said longitudinal axis of said shaft;

(e) a first friction member connected to said shaft, said first friction member having a first contact surface;

(f) a second friction member connected to said shaft, said second friction member having a second contact surface; and (g) means for biasing said first and second contact surfaces against each other to provide torsional resistance to rotation of said shaft, said resistance varying in a predetermined manner according to the angular position of said footplate by varying the extent of overlapping contact area between said first and second contact surfaces as said footplate is oscillated.

8. The apparatus of claim 7 wherein said first and second friction members are coaxial disks, said disks having said first and second contact surfaces perpendicular to said longitudinal axis, with said surfaces shaped as substantially matching, equally-spaced, circular sectors, said sectors having gaps less than 50° arc length between them.

9. The apparatus of claim 7 wherein said first and second contact surfaces are positioned to have maximum overlapping area when said footplate, secured to said user's foot, is substantially perpendicular to said user's lower leg, said contact surfaces having less overlapping area when said footplate is rotated beyond substantially perpendicular in either direction.

10. The apparatus of claim 7 wherein said torsional resistance is also varied by varying the radius to the perimeter of overlapping contact area between said first and second contact surfaces as said footplate is oscillated.

11. An apparatus attached to a user's foot for exercising the muscles of said user's lower leg and ankle, said apparatus comprising:

(a) a baseplate;

(b) a bearing block connected to said baseplate;

(c) a shaft rotatably mounted in said bearing block, said shaft having a longitudinal axis;

(d) a footplate connected to said shaft, said footplate adapted to secure said user's foot thereon with said user's ankle substantially aligned with said longitudinal axis of said shaft;

(e) a first friction member connected to said shaft, said first friction member having a first contact surface;

(f) a second friction member connected to said shaft, said second friction member having a second contact surface; and (g) means for biasing said first and second contact surfaces against each other to provide torsional resistance to rotation of said shaft, said resistance varying in a predetermined manner according to the angular position of said footplate by varying the radius to the perimeter of overlapping contact area between said first and second contact surfaces as said footplate is oscillated.

* * * * *